US008714145B2

(12) United States Patent
Maeda

(10) Patent No.: US 8,714,145 B2
(45) Date of Patent: May 6, 2014

(54) SEMIAUTOMATIC BULLET FIRING MECHANISM AND TOY GUN USING IT

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 42 days.

(21) Appl. No.: 13/620,246

(22) Filed: Sep. 14, 2012

(65) Prior Publication Data

US 2013/0263840 A1 Oct. 10, 2013

(30) Foreign Application Priority Data

Apr. 6, 2012 (JP) ..... 2012-087272

(51) Int. Cl.
*F41B 11/32* (2006.01)

(52) U.S. Cl.
USPC ..... 124/76

(58) Field of Classification Search
CPC ..... F41B 11/52; F41B 11/57; F41B 11/62; F41B 11/72; F41B 11/73
USPC ..... 124/76, 73, 74, 54, 56, 65–68, 70
See application file for complete search history.

(56) References Cited

U.S. PATENT DOCUMENTS

2004/0074486 A1* 4/2004 Schavone ..... 124/56
2011/0017057 A1* 1/2011 Loganchuk ..... 89/140

* cited by examiner

*Primary Examiner* — Michelle Clement
*Assistant Examiner* — John D Cooper
(74) *Attorney, Agent, or Firm* — Rader, Fishman & Grauer PLLC

(57) ABSTRACT

A mechanism for an open bolt type air gun includes a trigger that is pulled with a bolt in its retracted position. The mechanism includes a sear or an inner safety and a trigger bar. The sear is located behind and below the bolt and has a projection to come into contact with a locking projection of the bolt. The inner safety is located below the bolt and has a projection to come into contact with the locking projection of the bolt. A first trigger bar is located below the sear and has a bolt contact part which extends upward at its front end and comes into contact with a cam part of the bolt and a locking projection to lock the sear. A second trigger bar is located below the inner safety and forward of the first trigger bar and has a locking projection to lock the inner safety.

6 Claims, 13 Drawing Sheets

SEMIAUTOMATIC BULLET FIRING MECHANISM AND TOY GUN USING IT

CROSS-REFERENCE TO RELATED APPLICATION(S)

This application is based upon and claims the benefit of priority from Japanese Patent Application JP2012-087272, filed on Apr. 6, 2012, the entire disclosure of which is incorporated herein by reference.

TECHNICAL FIELD

The present invention relates to toy guns (so-called open bolt type toy guns which use compressed gas) in which a bolt is moved by a user pulling a trigger, the bolt opens a valve to jet out compressed gas, and a bullet is fired by the pressure of the compressed gas.

BACKGROUND ART

The automatic action of an air gun is either fully automatic or semiautomatic. In a firing mechanism for fully automatic action, when a user continues pulling a trigger, bullets are continuously fired until all bullets are exhausted. Since a gun which adopts a fully automatic mechanism has a disadvantage that bullets and gas are consumed at an accelerated pace and the accuracy of fire may deteriorate due to the strong recoil of the gun, in some cases guns which adopt a semiautomatic mechanism are more popular. In a semiautomatic action, the trigger is temporarily disconnected from the firing device (bolt, hammer, sear, etc.).

For example, an air gun as shown in FIG. 11 is known as a conventional open bolt type automatic toy air gun which has a disconnector for the abovementioned disconnection and uses compressed gas. Next, it will be described referring to FIGS. 11 to 13.

FIG. 11 shows the initial state of a conventional open bolt type air gun. The gun body includes a frame 201, a bolt 202, a bolt spring 203, a trigger 204, a trigger spring 205, a sear 206, a sear spring 207, and a sear locking projection 208. As shown in FIG. 12, as the bolt 202 is pulled toward the back of the gun by hand, the bolt moves backward against the biasing force of the bolt spring and locked by a sear lock to stand by for firing. As the trigger is pulled, the sear is released from the bolt and the bolt quickly moves forward by the biasing force of the bolt spring and a hit pin 209 hits a discharge valve 211 in a valve body 210. Consequently, the discharge valve moves forward, which breaks the air tightness in the valve body and fires a bullet by the compressed air which fills the valve body.

Then, the compressed gas in the valve body 210 goes not only toward the muzzle but also toward the rear of the bolt to push the bolt backward, so the bolt begins moving backward against the biasing force of the bolt spring. After the bolt has moved back all the way, the bolt attempts to move forward by the biasing force of the bolt spring, but as shown in FIG. 13, it is locked by the sear 206, which has been returned to its initial state by the sear spring, and stopped while it is held in its cocking position.

At this time, as the user lets his/her finger go from the finger rest of the trigger, the initial state as shown in FIG. 11 is restored by the trigger spring and by pulling the trigger again, a bullet can be fired. Bullets can be fired continuously (semiautomatically) by repeating this cycle.

However, if the gas pressure becomes low and the bolt fails to move backward to the position where it is locked by the sear, the bolt would reciprocate or move forward and backward and bullets would be fired continuously (fully automatically).

SUMMARY OF THE INVENTION

Technical Problem

As mentioned above, a fully automatic gun has a disadvantage that bullets and gas are consumed at an accelerated pace and the accuracy of fire deteriorates due to the strong recoil of the gun. On the other hand, the conventional semiautomatic mechanism has a problem that if the gas pressure drops, bullets may be fired fully automatically.

With this background, the present invention has an object to provide a simpler mechanism which ensures reliable semiautomatic action for an open bolt type air gun in which the trigger is pulled with the bolt in its retracted position.

Solution to Problem

In order to solve the above problem, the present invention provides a simpler mechanism for semiautomatic action which includes a sear and/or an inner safety, and a trigger bar. More specifically, according to one aspect of the present invention, there is provided a toy gun which includes: a barrel extending in a longitudinal direction of a gun body; a valve body in the shape of a cylinder extending in the longitudinal direction of the gun body, forming therein an air chamber filled with compressed gas, communicating with a rear end of the barrel at a front side and having a through hole penetrating in the longitudinal direction of the gun body at a rear side; a discharge valve located inside the valve body, provided movably between a closed position for closing communication between the barrel and the air chamber and an open position, more forward than the closed position, for opening the communication between the barrel and the air chamber; a discharge valve spring pushing the discharge valve backward and bringing the discharge valve into the closed position; a bolt located slidably in the longitudinal direction of the gun body, having an opening at the front and a closed end at the rear, having therein a contact part for pushing the discharge valve from behind, having, on a lateral side, a cam part oriented backward from a portion extending in a forward direction of the gun body, and having a locking projection extending downward from a bottom of the rear closed end and sloping upward from front to back; a bolt spring pushing the bolt forward; a sear located below the bolt, having a projection to come into contact with the locking projection of the bolt; a first trigger bar located turnably below the sear, having a bolt contact part extending upward at or around a front end to come into contact with the cam part of the bolt, and on a lateral side, a locking projection for locking the sear; an inner safety located forward of the sear, having a projection to come into contact with the locking projection of the bolt; and a second trigger bar located below the inner safety and forward of the first trigger bar, slidably in the longitudinal direction, having on a lateral side a locking projection for locking the inner safety.

Preferably, in the above toy gun, the sear includes a shaft, a backward protrusion extending backward from the shaft, a downward protrusion extending downward from the shaft, and a locking projection protruding upward from a rear end of the backward protrusion to come into contact with the locking projection of the bolt and/or the inner safety includes a shaft, a backward protrusion extending backward from the shaft, a downward protrusion extending downward from the shaft, and a locking projection protruding upward from a rear end of the backward protrusion to come into contact with the locking projection of the bolt.

Furthermore, in the above toy gun, preferably the cam part of the bolt is so shaped as to have a front flat portion, a middle slope, and a rear flat portion in order continuously from front to back.

Furthermore, in the above toy gun, preferably the first trigger bar and the second trigger bar are arranged so that when the valve moves backward and engages with the sear and the trigger coupled to the first trigger bar is in its initial state, the front end of the first trigger bar comes into contact with the rear end of the second trigger bar and the first trigger bar and the second trigger bar are in alignment with each other.

Advantageous Effects of the Invention

According to the present invention, in an open bolt type automatic air gun, even if the trigger is continuously pulled, bullets are prevented from being fired continuously because the bolt is locked by the sear. In other words, a single firing action takes place each time the trigger is pulled once and even if the trigger is continuously pulled, the firing action is not repeated. In addition, according to the present invention, this semiautomatic firing mechanism can be implemented by a relatively simple mechanism including a sear and a trigger bar with a sear locking projection. In addition, according to the present invention, the adoption of an inner safety and a second trigger bar with an inner safety locking projection prevents accidental continuous firing even if the compressed gas pressure drops.

DESCRIPTION OF EMBODIMENTS

In this specification, "semiautomatic" means a mode of action that a bullet is fired once by pulling a trigger once and even if the trigger is continuously pulled, the firing action is not repeated. Next, embodiments which are illustrative of the present invention will be described but the present invention is not limited thereto.

Figure 1:
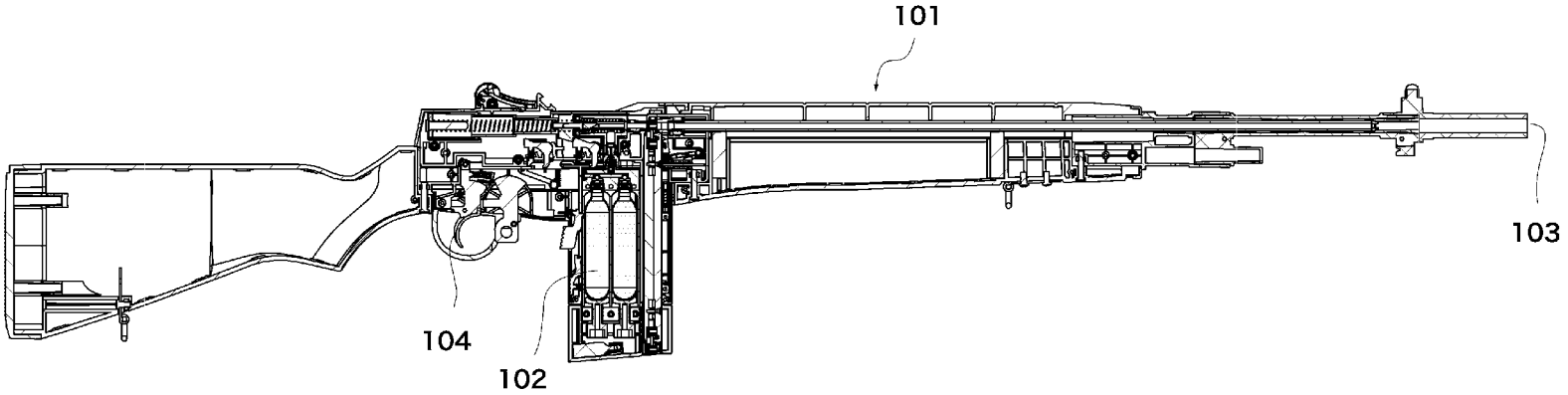
FIG. 1 is aright side sectional view of the entire internal structure of an air gun according to an embodiment of the present invention.

FIG. 1 is a right side sectional view of a toy gun 101 according to an embodiment of the present invention. The toy gun 101 is a semiautomatic toy gun which is used with a compressed gas cylinder 102 attached thereto. This toy gun 101 gives the pressure of compressed gas filled in the compressed gas cylinder 102 to a bullet B to fire the bullet B through a muzzle 103. The air gun 101 has a slide which can slide toward the rear end of the gun on a lateral side of the gun; the slide is slid toward the rear end of the gun and returned to its initial position to finish the preparatory step for firing. The user puts the gunstock of the toy gun 101 on his/her shoulder and puts his/her finger on a trigger 104 and directs the muzzle 103 toward the object of shooting (target). Then, the user moves the finger to pull the trigger 104 in the backward direction of the toy gun 101 to fire the bullet B through the muzzle 103.

FIGS. 2 to 10 are left side sectional views showing the internal structure of the toy gun 101. In FIGS. 2 to 10, the muzzle, trigger guard and gunstock are omitted. In the explanation below, the side where the muzzle 103 is located is referred to as the muzzle side or forward direction and the side where the trigger is located is referred to as the gun rear side or backward direction.

Figure 2:
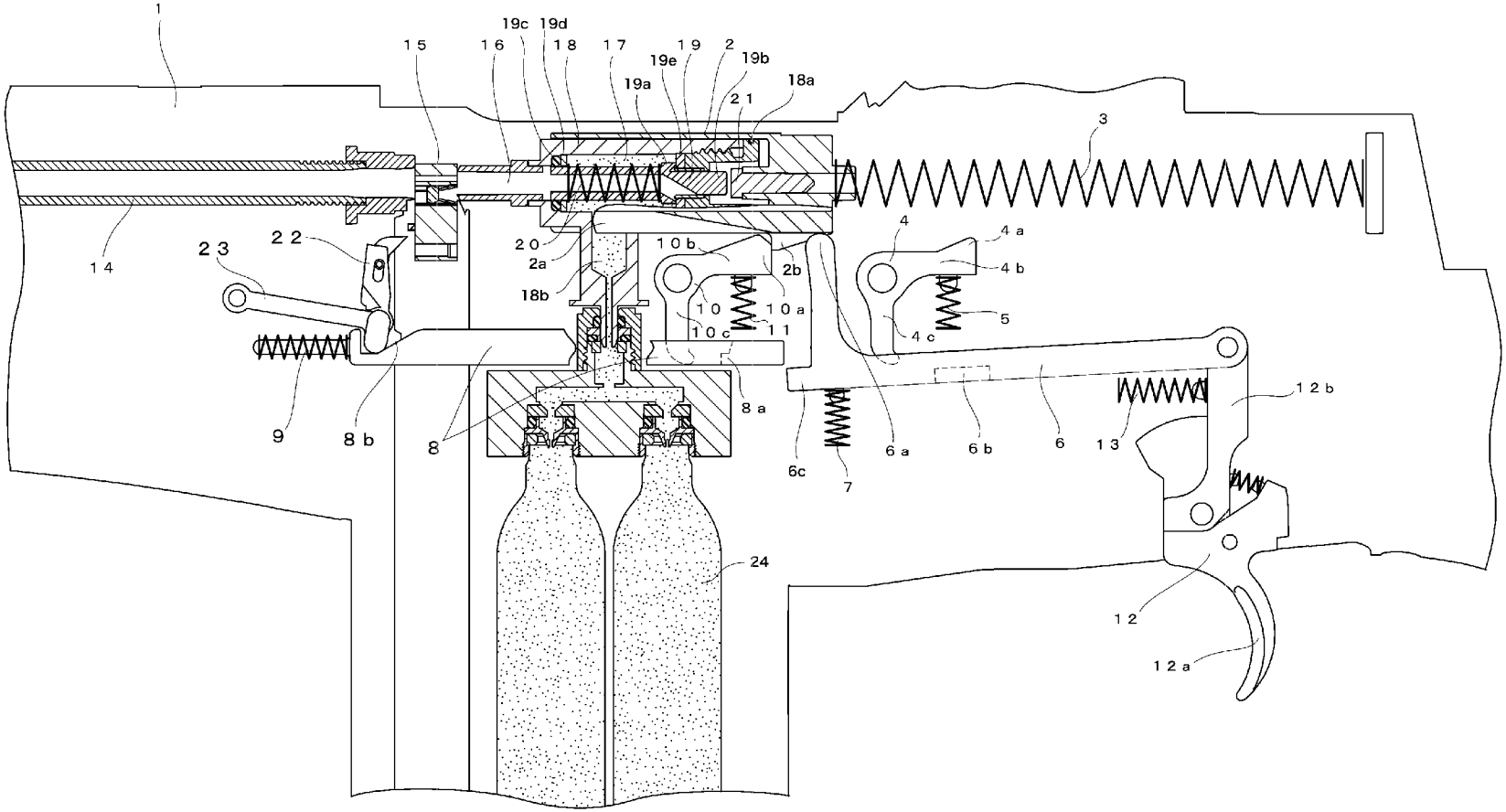
FIG. 2 is a left side sectional view showing the initial state of the air gun according to the embodiment.

FIG. 2 shows the initial state of the air gun according to this embodiment. Next, the components of the gun body will be described referring to FIG. 2. The gun body includes a frame 1, a valve, a bolt 2, a hit pin 21, a bolt spring 3, a trigger 12, a trigger spring 13, trigger bar A 6, a trigger bar A spring 7, a trigger bar B 8, a trigger bar B spring 9, a sear 4, a sear spring 5, an inner safety 10, and an inner safety spring 11.

First, the components located in the front portion of the toy gun 101 will be described. The toy gun 101 includes a frame 1 as a housing, and a barrel 14. In this embodiment, the frame 1 is part of the gun body and defines the front-back or longitudinal direction of the toy gun 101. The barrel 14 is a tubular member extending in the longitudinal direction of the gun body. The front end of the barrel 14 is a muzzle. The inside diameter of the barrel 14 is almost equal to the diameter of the bullet B. The barrel 14 is located on the front side of the frame 1. In this embodiment, the barrel 14 protrudes from the frame 1 in the forward direction of the gun body. Alternatively, the barrel 14 may be housed in the frame 1.

The bolt 2 is a cylindrical member housed in the frame 1, extending in the longitudinal direction of the gun body and located in a way that it can slide freely in the longitudinal direction of the gun body. The front of the bolt 2 is an open end. A cocking lever (not shown) is attached to the bolt 2 so that the bolt 2 can be moved backward manually. The rear of the bolt 2 is a closed end. A hit pin 21 is provided at the closed end, protruding toward the valve body 18. The hit pin 21 is fitted into the fitting hole at the rear end of the valve body 18. The bolt 2 has a cam part 2*a* on a lateral side thereof. The cam part 2*a* is oriented backward from its portion extending in the forward direction of the gun body. As shown in FIG. 2, the depth of the cam part 2*a* (distance from the bottom of the bolt 2) is not uniform. More specifically, the cam part 2*a* has a front flat portion, a middle slope, and a rear flat portion, which extend in order continuously from front to back. The bolt 2 also has a locking projection 2*b*. The locking projection 2*b* extends downward from the closed end side bottom, sloping upward from front to back. The locking projection 2*b* of the bolt 2 comes into contact with the projection of the sear 4 and the projection of the inner safety 10. The bolt spring 3 is located between the outer face of the closed end of the bolt 2 and the rear inner face of the frame 1, biasing the bolt 2 forward.

The valve body 18 is a cylindrical member fixed in the frame 1. The outside diameter of the valve body 18 is smaller than the inside diameter of the bolt 2. As the bolt 2 moves forward, the bolt envelops the valve body 18. A space for a discharge valve 19 to slide forward is provided in the inner front space of the valve body 18. A rear lid 18*a* is attached to the rear end of the valve body. The rear lid 18*a* has a through hole which enables the outside of the valve body 18 to communicate with the inside of the discharge valve 19. The rear of the through hole has a larger inside diameter to function as a fitting hole. The hit pin 21 of the bolt 2 is fitted into the fitting hole from outside the valve body 18. Also a sliding projection provided on the discharge valve 19 enters into the through hole from inside the valve body 18. This sliding projection protrudes on the fitting hole side. A gas inlet path 18*b* is formed in the valve body 18. For the gas inlet path 18*b*, the valve body 18 is shaped so as to have a downward protrusion and is fitted in the frame 1, protruding downward. A compressed gas cylinder 24 is attached to the tip of the gas inlet path 18*b*. The compressed gas cylinder 24 feeds compressed gas into the valve body through the gas inlet path. An air chamber 17 is formed inside the valve body 18. A gas passage 16 extends from the front of the air chamber 17. The rear of the air chamber 17 is closed by the rear lid 18*a*.

The discharge valve 19 is a cylindrical member with an open front end. The outside diameter of the discharge valve 19 is smaller than the inside diameter of the valve body. This discharge valve 19 is located inside the valve body 18 to form the air chamber 17 between the valve body 18 and discharge valve 19. A flange part 19*a* and a sliding projection 19*b* are provided on the rear end side of the discharge valve 19. The flange part 19*a* radially protrudes from the periphery of the valve. The sliding projection 19*b* enters into the through hole and protrudes on the fitting hole side. The discharge valve 19 forms a straight path and a sloped path for compressed gas to pass through. The straight path has an opening on the front end face of the valve, stretching in the longitudinal direction of the barrel 14. The sloped path is continuous with the straight path, stretching in a direction sloped with respect to the straight path with an opening between the flange part 19*a* and sliding projection 19*b*. An O ring 19*c* and a washer 19*d* are fitted to the periphery of the front end of the discharge valve 19. The O ring 19*c* lies between the washer 19*d* and the inner wall of the valve body 18. A discharge valve spring 20 is located between the washer 19*d* and flange part 19*a* and disposed in a way to be wound around the discharge valve 14. The discharge valve spring 20 pushes the washer 19*d* forward and pushes the O ring 19*c* against the inner wall of the valve body 18. The discharge valve spring 20 pushes the flange part 19*a* against a packing 19*e*. This blocks the communication between the straight path and sloped path in the discharge valve and the air chamber.

The trigger 12 is located below the frame 1. The trigger 12 is attached to the frame 1 in a way to be rotatable around a fulcrum. The trigger 12 has a finger rest 12*a* and an upward extension 12*b*. The finger rest 12*a* extends downward from the fulcrum and the upward extension 12*b* extends upward from the fulcrum. The trigger bar A 6 is turnably coupled to the top end of the upward extension 12*b*. The upward extension 12*b* is biased by the trigger spring 13 clockwise as seen in the figure. Just after the trigger is turned with a finger on the finger rest 12*a*, the upward extension 12*b* does not turn. As the finger rest 12*a* turns to a certain extent, the finger rest 12*a* and the upward extension 12*b* touch each other and the upward extension 12*b* begins turning, which moves the trigger bar A 6 forward. This is a safeguard which prevents a bullet from being fired even if a finger accidentally touches the finger rest 12*a* and moves it. This safeguard is omissible and the finger rest 12*a* and upward extension 12*b* may be integrated to make up the trigger 12.

The trigger bar A 6 is turnably located above the trigger 12 in the frame 1. A bolt contact part 6*a* at the top of the trigger bar A 6 comes into contact with the cam part 2*a* of the bolt 2. As the bolt contact part 6*a* moves up and down along the cam part 2*a* of the bolt 2, the trigger bar A 6 turns according to forward and backward reciprocating motion of the bolt 2. As the bolt 2 moves, the bolt 2 turns the trigger bar A 6, which causes the trigger bar A 6 to engage with, or disengage from, the sear 4. The trigger bar A 6 has a sear locking projection 6*b* on a lateral side thereof. Although the sear locking projection is located on the lower part of the lateral side of the trigger bar A 6 in the example shown in the figure, its location is not limited thereto as far as it is located on a lateral side of the trigger bar A. The trigger bar A 6 is biased toward the bolt by the trigger bar A spring 7 at or around the muzzle side end. The trigger bar A 6 has a trigger bar B contact part 6*c* at or around the muzzle side end. In the state shown in FIG. 2, the bolt 2 is in a forward position and the bolt contact part of the trigger bar A 6 is in contact with the rear end flat portion of the cam part 2*a* of the bolt 2. At this time, the trigger bar A 6 is held pushed down by the bolt 2.

The trigger bar B 8 is located forward of the trigger bar A 6 in a way to be slidable forward and backward. An inner safety locking projection 8*a* is provided on a lateral side of the trigger bar B 8. The trigger bar B 8 is biased backward by the trigger bar B spring 9. The trigger bar B 8 has a slope part 8*b* on its front portion.

The sear 4 is turnably located below the bolt 2 and bolt spring in the frame 1. The sear 4 includes a shaft, a backward protrusion 4*b* extending backward of the shaft, and a downward protrusion 4*c* extending downward from the shaft. A bolt locking projection 4*a* which protrudes upward to stop forward movement of the bolt 2 is provided on the gun rear end side upper portion of the backward protrusion 4*b* of the sear 4. A sear spring 5 is provided under the backward protrusion of the sear 4. The sear spring 5 biases the sear 4 counterclockwise as seen in the figure and holds up the backward protrusion 4*b*. While the backward protrusion 4*b* of the sear 4 is held up, the bolt 2 cannot move forward.

The inner safety 10 is turnably located below the bolt 2 and bolt spring 3 in the frame 1 like the sear 4, nearer to the muzzle end than the sear. Also it is similar to the sear in that it includes a shaft, a backward protrusion 10*b* extending backward of the shaft, a downward protrusion 10*c* extending downward from the shaft and a bolt locking projection 10*a*, provided on the gun rear end side upper portion of the backward protrusion, which protrudes upward to stop forward movement of the bolt 2. An inner safety spring 11 is provided on the backward protrusion 10*b*. The inner safety spring 11 biases the inner safety 10 counterclockwise as seen in the figure and holds up the backward protrusion 10*b*. While the backward protrusion 10*b* of the inner safety 10 is held up, the bolt 2 cannot move forward. The inner safety 10 in its initial state is in contact with the locking projection 2*b* at the rear end of the bolt 2. In this embodiment, the sear 4 and inner safety 10 are almost equal in size and similar to each other in appearance; however, the sear 4 and inner safety 10 may differ in size depending on the type of gun.

If the gun in the initial state is tilted, the bolt 2 may move forward, which might cause the hit pin in the bolt 2 to hit the valve and result in an accidental firing. The inner safety prevents forward movement of the bolt 2 in its initial position in order to avoid such an accidental firing.

A magazine 15 is located at the rear end of the barrel 14. In this embodiment, the magazine is detachably housed in a grip A together with the compressed air cylinder 24; alternatively it may be located forward of the grip. In this embodiment, the magazine 15 includes a cylinder as a cylindrical member and a box type magazine body with a cylinder at one end or both ends. The cylinder has one or more bullet holding holes on its bottom and can turn around the shaft. The bullet holding hole is a hole which is large enough to house a bullet (either a BB bullet or a pellet bullet or both). For an air gun having this type of magazine 15, a nail or similar means for turning the magazine 15 is needed (as explained later). However, the magazine need not be of the rotary type. The type of magazine 15 may vary depending on the shape of the gun; for example, it may be a box type magazine which is inserted from below.

If the rotary magazine 15 is used as in this embodiment, a nail 22 is provided in the gun body. The nail 22 rotates the magazine 15 and places the bullet holding hole in a position opposite to the rear end of the barrel 14. The nail 22 is coupled to a nail support arm 23 turnably provided on the frame 1 and located above the slope portion 8*b* of the trigger bar B 8.

Figure 3:
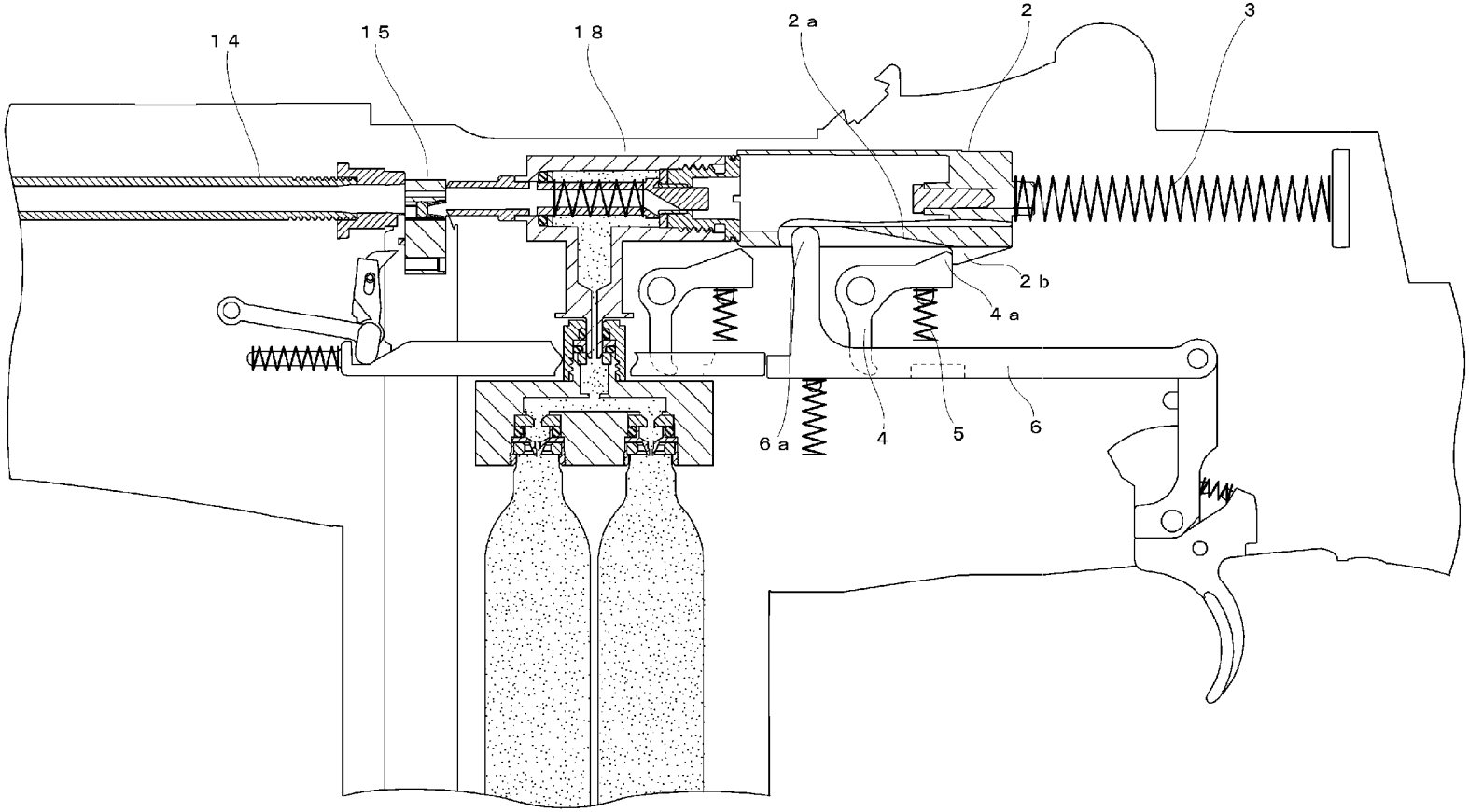
FIG. 3 is a left side sectional view showing a "cocked state" after the initial state shown in FIG. 2.

Next, "cocked state" will be explained referring to FIG. 3.

As the user pulls the bolt 2 backward, the bolt 2 moves backward against the biasing force of the bolt spring 3. In the course of backward movement of the bolt 2, the locking projection 2*b* of the bolt 2 touches the bolt locking projection 4*a* of the sear 4 and rides over it. At this instant, the sear 4 turns against the biasing force of the sear spring 5. As the bolt 2 further moves backward and reaches the most retracted position, the locking projection 2*b* of the bolt 2 locks the bolt 2 with the bolt locking projection 4*a* of the sear 4 to stop the bolt 2.

The trigger bar A 6, which has been held down by the bolt 2, turns as the bolt 2 moves backward. As the bolt 2 moves backward, the bolt contact part 6*a* of the trigger bar A 6 moves from the rear flat portion of the cam part 2*a* of the bolt 2 through the slope portion and comes into contact with the front flat portion. The trigger bar A 6 stops turning at the instant it virtually comes into alignment with the trigger bar B 8.

Figure 4:
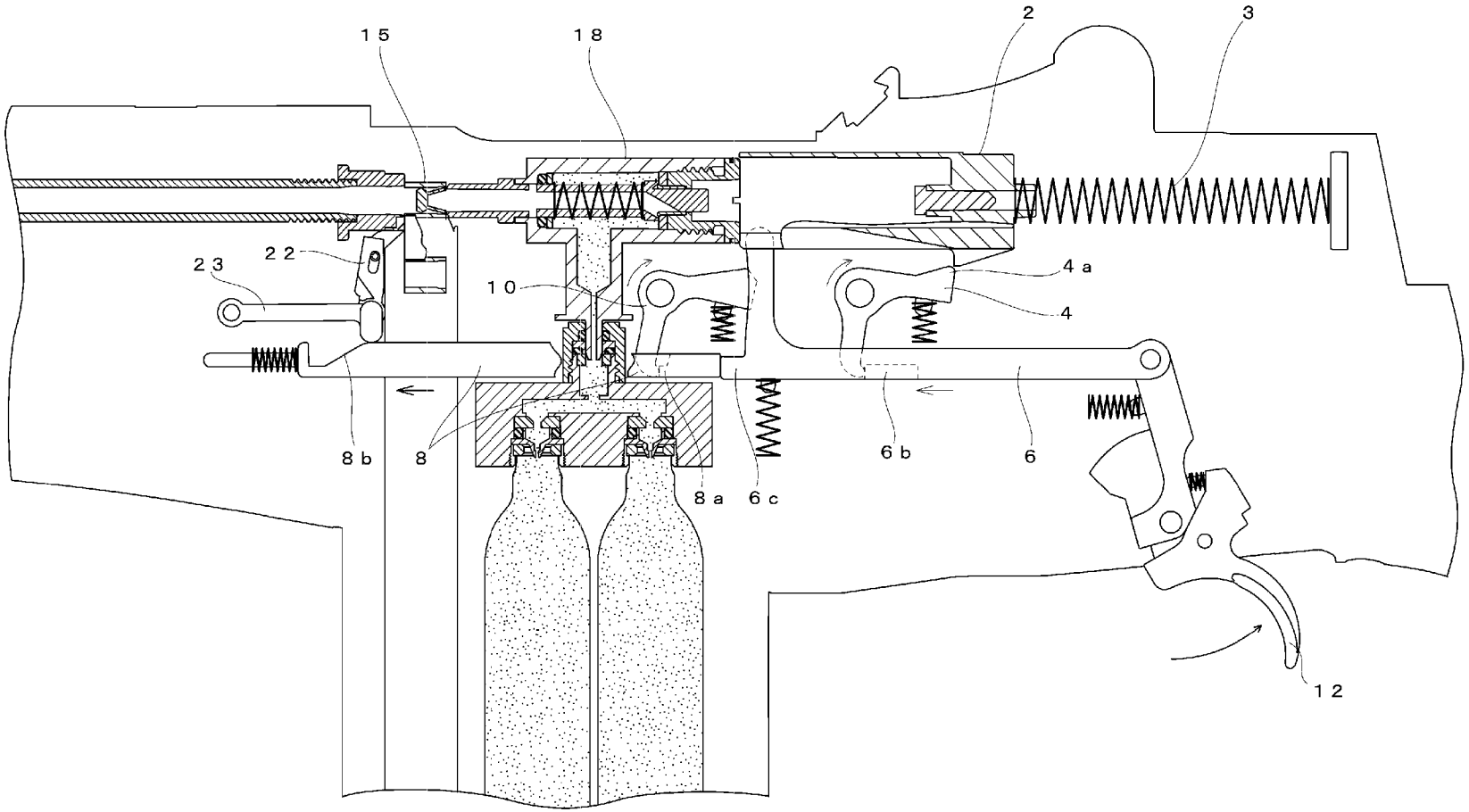
FIG. 4 is a left side sectional view showing a state in which a sear is released by pulling the trigger after the state shown in FIG. 3.

Next, a state in which the sear is released from the bolt after the trigger is pulled will be explained referring to FIG. 4.

As the user pulls the trigger 12, the trigger bar A 6 engaged with the trigger 12 moves forward (arrow in the figure). The sear locking projection 6*b* of the trigger bar A 6 also moves forward and pushes the sear 4 to turn the sear 4. As the trigger bar A 6 moves forward, the trigger bar B contact part 6*c* at the front of the trigger bar A 6 touches the rear of the trigger bar B 8 and the trigger bar B 8 also begins moving forward (arrow in the figure). The inner safety locking projection 8*a* of the trigger bar B 8 also moves forward and pushes the inner safety 10 to turn the inner safety 10. As the trigger bar B 8 moves forward, the nail support arm 23 turns while ascending the slope portion 8*b* of the trigger bar B 8, and the nail 22 coupled to the nail support arm 23 moves up and engages with the magazine 15 to turn the magazine 15. As a consequence, the bullet in the magazine 15 is brought into alignment with the barrel 14. As the sear 4 turns, the bolt locking projection 4*a* of the sear 4 is no longer in a position to lock the bolt 2. Also, as the inner safety 10 turns, the bolt locking projection 10*a* of the inner safety 10 is in a position not to interfere with the bolt 2. Therefore, immediately after the bolt 2 and the sear 4 are unlocked from each other, the bolt 2 quickly moves forward by the biasing force of the bolt spring 3.

Figure 5:
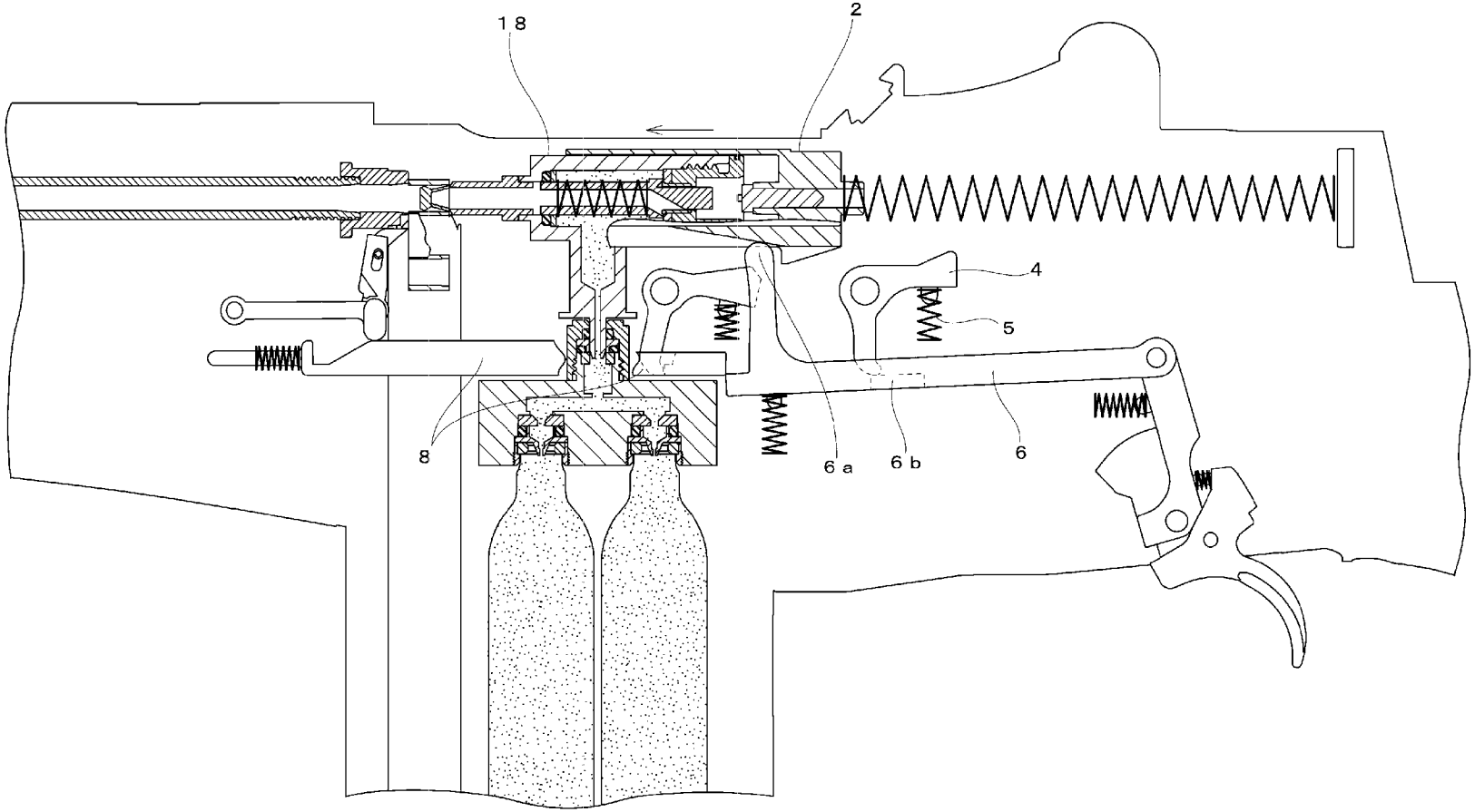
FIG. 5 is a left side sectional view showing a state in which forward movement of a bolt pushes down a trigger bar A and the sear returns to its initial state after the state shown in FIG. 4.

Next, a state in which forward movement of the bolt pushes down the trigger bar A and the sear returns to its initial state will be explained referring to FIG. 5.

As the bolt 2 moves forward, the bolt contact part 6*a* of the trigger bar A 6 moves from the front flat portion and comes into contact with the middle slope. Consequently the trigger bar A 6 is pushed down gradually. This unlocks the sear 4 from the sear locking projection 6*b* of the trigger bar A 6 and returns the sear 4 to its initial position by the biasing force of the sear spring 5. At this moment, the trigger bar A 6 and trigger bar B 8 are still barely in contact with each other.

Figure 6:
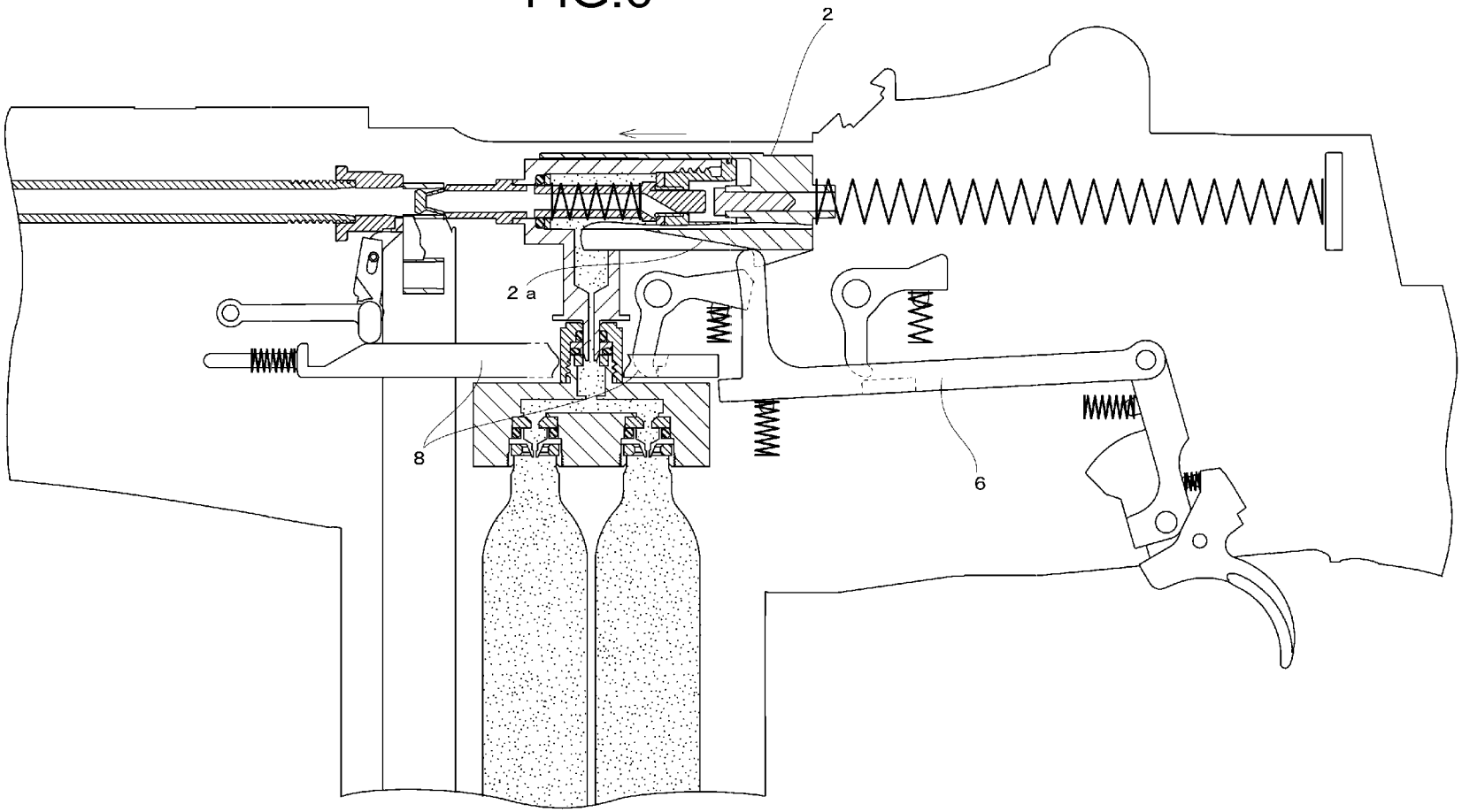
FIG. 6 is a left side sectional view showing a state in which the bolt further moves forward after the state shown in FIG. 5.

Next, a state in which the bolt further moves forward will be explained referring to FIG. 6. As the bolt 2 further moves forward, the trigger bar A 6 is further pushed down by the middle slope of the cam part 2*a* of the bolt 2 and finally the trigger bar A 6 and trigger bar B 8 depart from each other.

Figure 7:
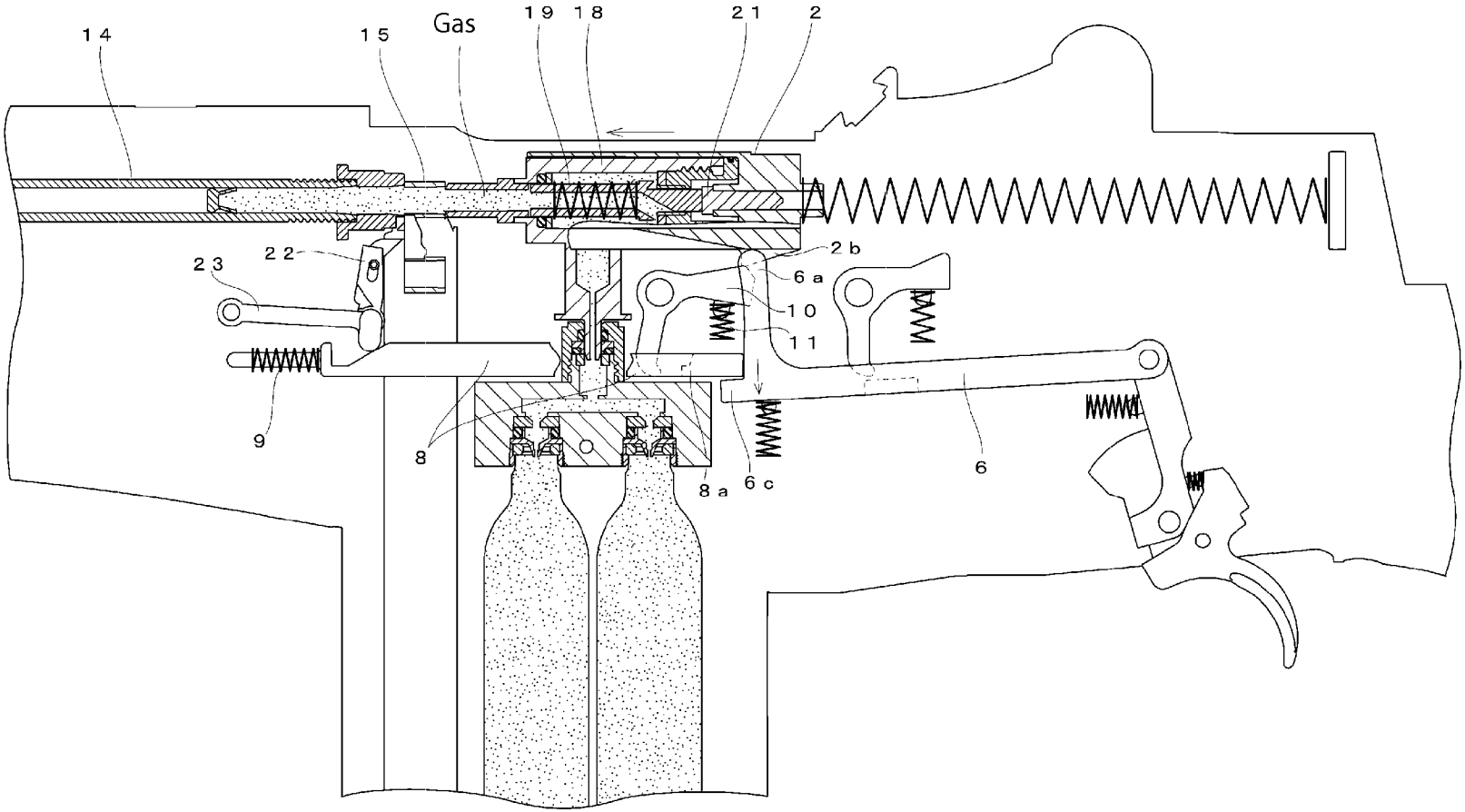
FIG. 7 is a left side sectional view showing a state in which the bolt opens a valve after the state shown in FIG. 6.

Next, a state in which the bolt opens the valve will be explained referring to FIG. 7.

As the bolt 2 continues moving forward, the hit pin 21 in the bolt 2 hits the discharge valve 19 in the valve body 18. This moves the discharge valve 19 forward and breaks the air tightness in the valve body 18. Then, compressed gas which fills the inside of the valve body 18 flows through the gas passage in the discharge valve 19 toward the bullet in the rotary magazine 15. The bullet is fired through the barrel 14 by the gas pressure.

On the other hand, the bolt contact part 6*a* of the trigger bar A 6 moves from the middle slope on the bottom of the bolt and touches the rear flat portion. Consequently the trigger bar A 6 is further pushed down by the bolt 2. Due to the biasing force of the trigger bar B spring 9, the trigger bar B 8 moves backward and rides over the trigger bar B contact part 6*c* of the trigger bar A 6 which is held down. Consequently the trigger bar B 8 stops moving backward. As the trigger bar B 8 moves backward, the nail support arm 23 turns while descending the front slope of the trigger bar B 8 and the nail 22 coupled to the nail support arm 23 disengages from the rotary magazine 15 and moves down. As the trigger bar B 8 moves backward, the inner safety 10 and the inner safety locking projection 8*a* of the trigger bar B 8 depart from each other. Therefore, the inner safety 10 attempts to turn counterclockwise (as seen in the figure) by the biasing force of the inner safety spring 11 in order to return to its initial position; however, the locking projection 2*b* of the bolt 2 comes into contact with the inner safety 10 and prevents it from turning, so it cannot return to the initial position.

Figure 8:
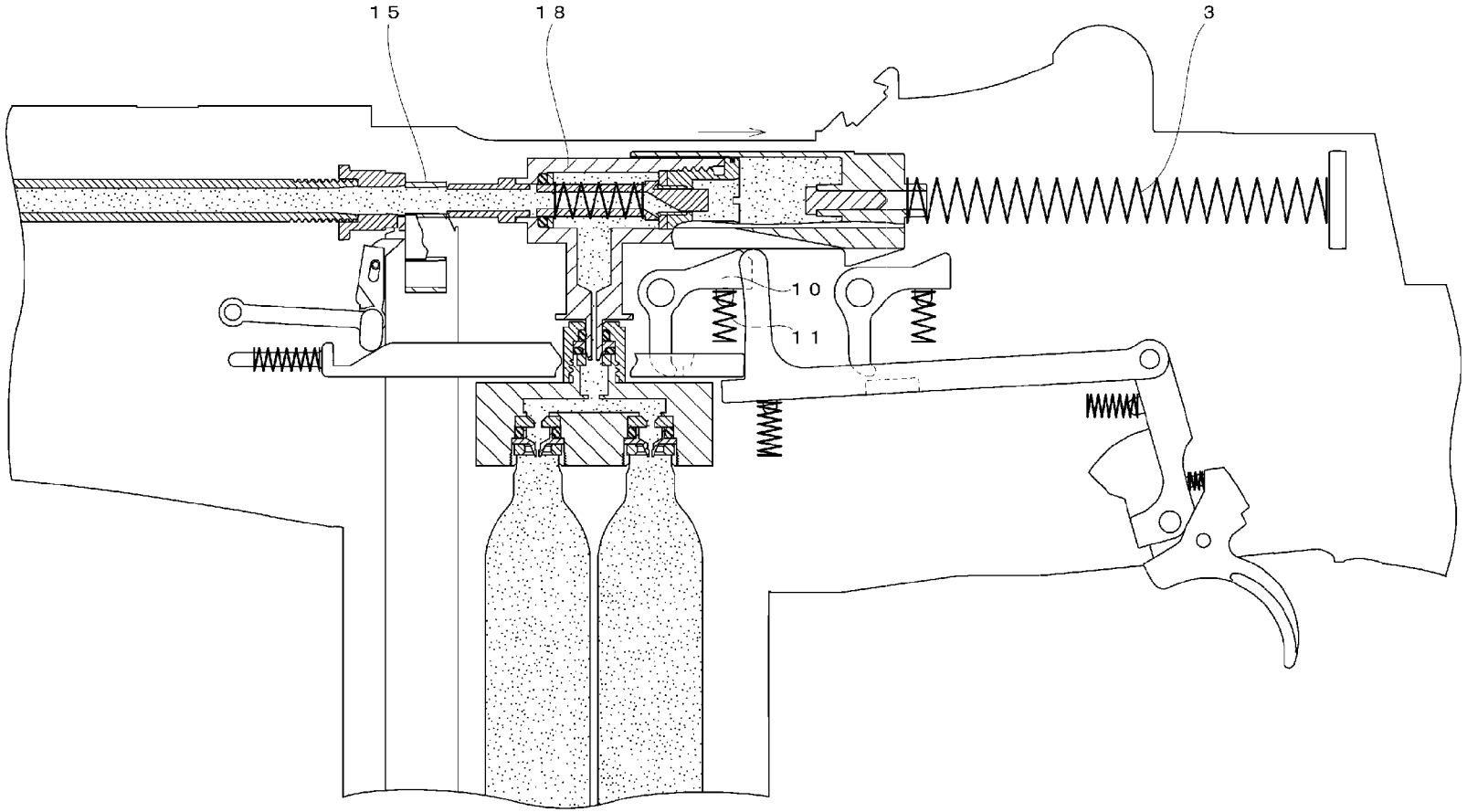
FIG. 8 is a left side sectional view showing a state in which the bolt begins moving backward and an inner safety returns to its initial state after the state shown in FIG. 7.

Next, a state in which the bolt begins moving backward and the inner safety returns to its initial state will be explained referring to FIG. 8.

The compressed gas in the valve body 18 flows not only toward the magazine 15 but also backward or toward the bolt 2 and pushes the bolt 2 backward. Consequently the bolt 2 begins moving backward against the biasing force of the bolt spring 3. As the bolt 2 moves backward and the bolt 2 and the inner safety 10 depart from each other, the inner safety 10 returns to its initial position by the biasing force of the inner safety spring 11.

Figure 9:
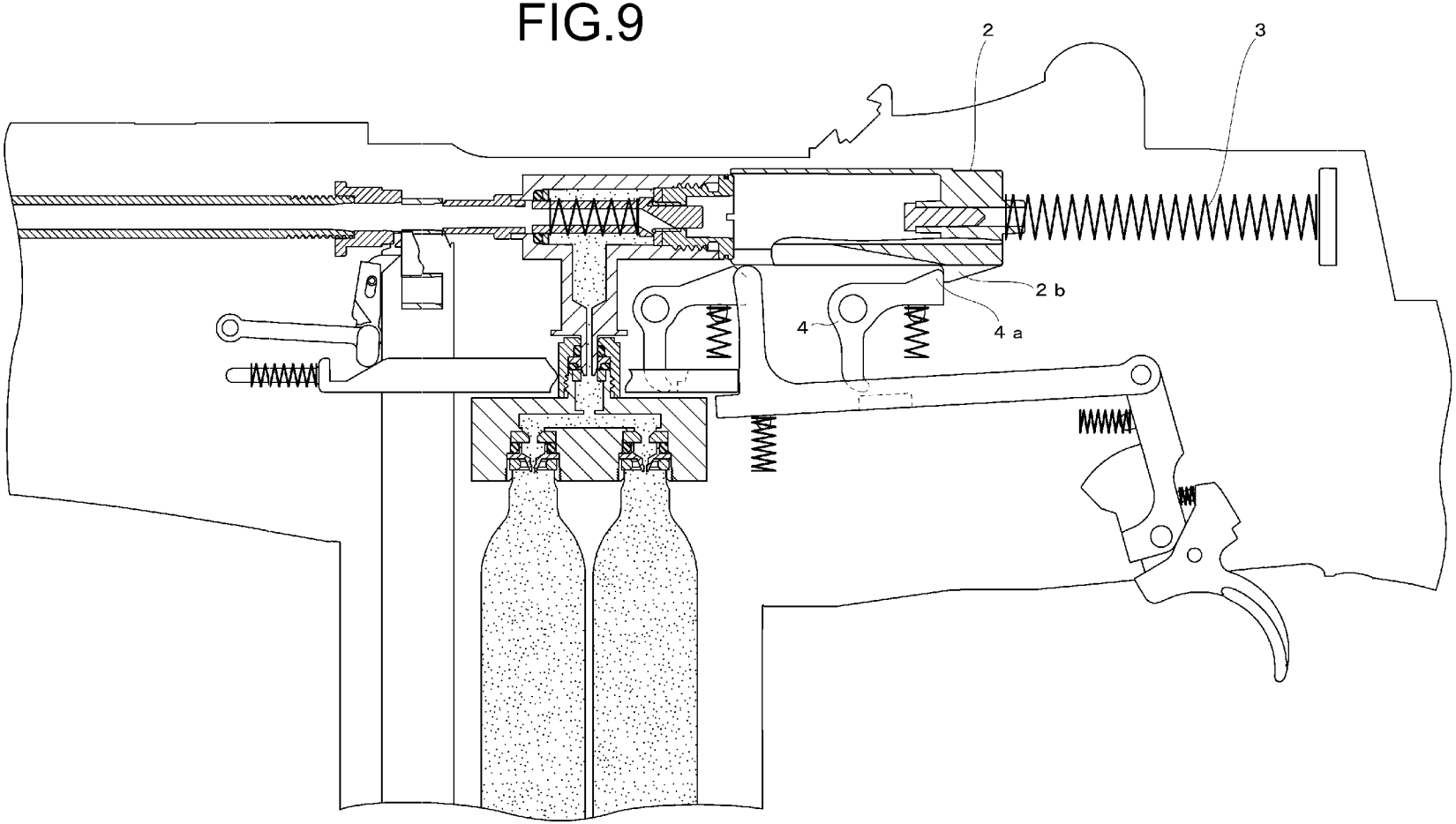
FIG. 9 is a left side sectional view showing a state in which the bolt moves backward and is locked by the sear after the state shown in FIG. 8.

Next, a state in which the bolt moves backward and is locked by the sear will be explained referring to FIG. 9. After the bolt 2 moves backward all the way, the bolt 2 attempts to move forward by the biasing force of the bolt spring 3. However, since the bolt locking projection 4*a* of the sear 4 in its initial state engages with the locking projection 2*b* of the bolt 2, the bolt 2 cannot move forward and stops while held in the cocked state.

When the user lets his/her finger go from the finger rest of the trigger 12 in this state, the upward extension 12*b* turns clockwise by the trigger spring 13. Consequently the trigger bar A 6, turnably coupled to the top end of the upward extension 12*b*, moves backward and returns to the state as shown in FIG. 3. When the user pulls the trigger 12 again, the trigger bar A 6, engaged with the trigger 12, moves forward and the sear locking projection 6*b* of the trigger bar A 6 also moves forward and pushes the sear 4, so the sear 4 turns and the bolt locking projection 4*a* of the sear 4 is no longer in the position to lock the bolt 2. Furthermore, as the trigger bar A 6 moves forward, the trigger bar B contact part 6*c* at the front of the trigger bar A 6 touches the rear of the trigger bar B 8 and the trigger bar B 8 also moves forward. Also, the inner safety locking projection 8*a* of the trigger bar B 8 moves forward and pushes the inner safety 10, so the inner safety 10 turns and the bolt locking projection 10*a* of the inner safety 10 is brought into a position not to interfere with the bolt 2. Then, the bullet is fired through the barrel 14 by the gas pressure as explained above.

After that, again the bolt 2 is pushed and moved backward by the compressed gas in the valve body 18 and locked by the sear which has returned to its initial state. By repeating the above cycle, bullets can be fired continuously or semiautomatic shooting can be performed.

Figure 10:
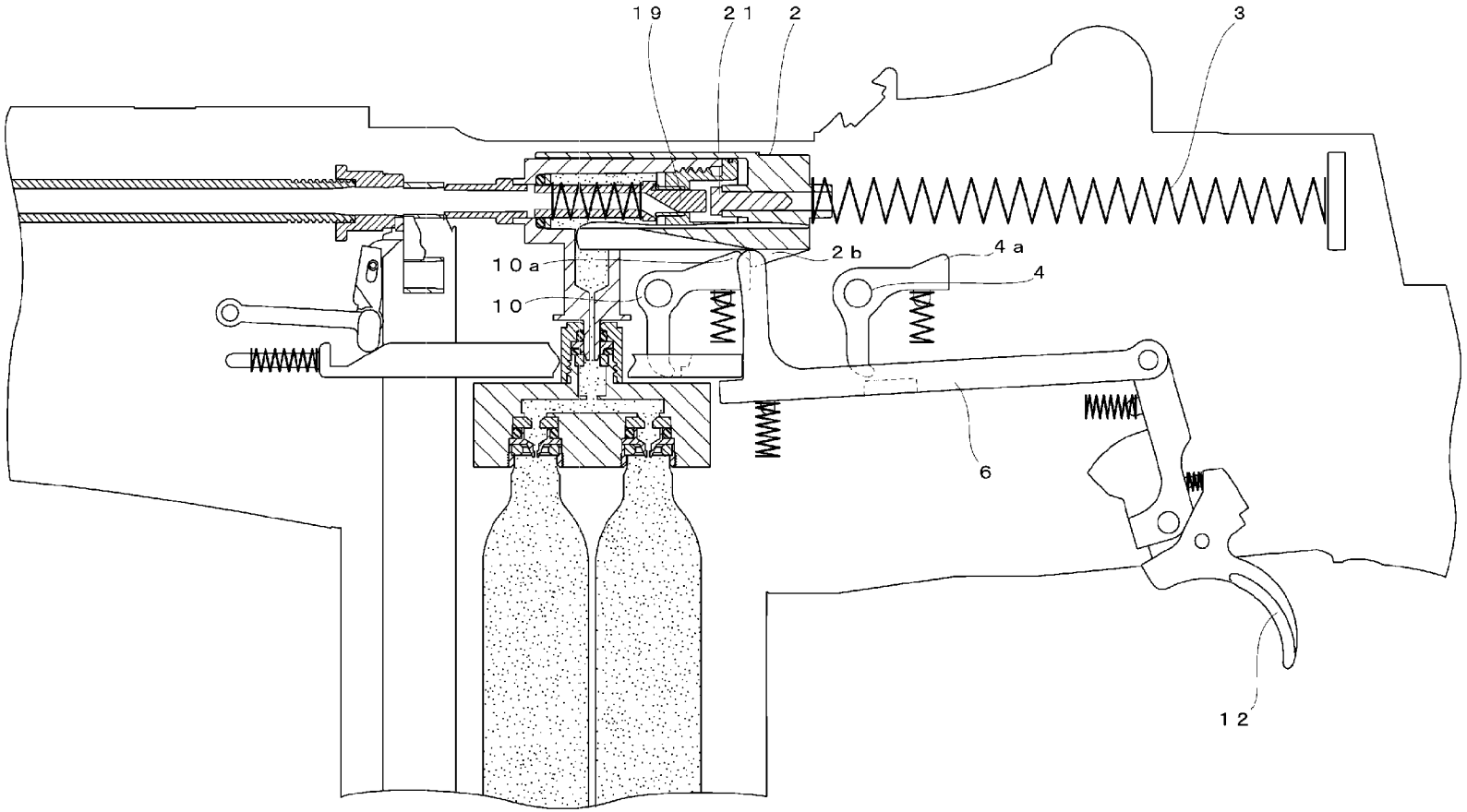
FIG. 10 is a left side sectional view showing a state in which the bolt does not move backward enough to touch the sear and the bolt stops after the state shown in FIG. 7.
Figure 11:
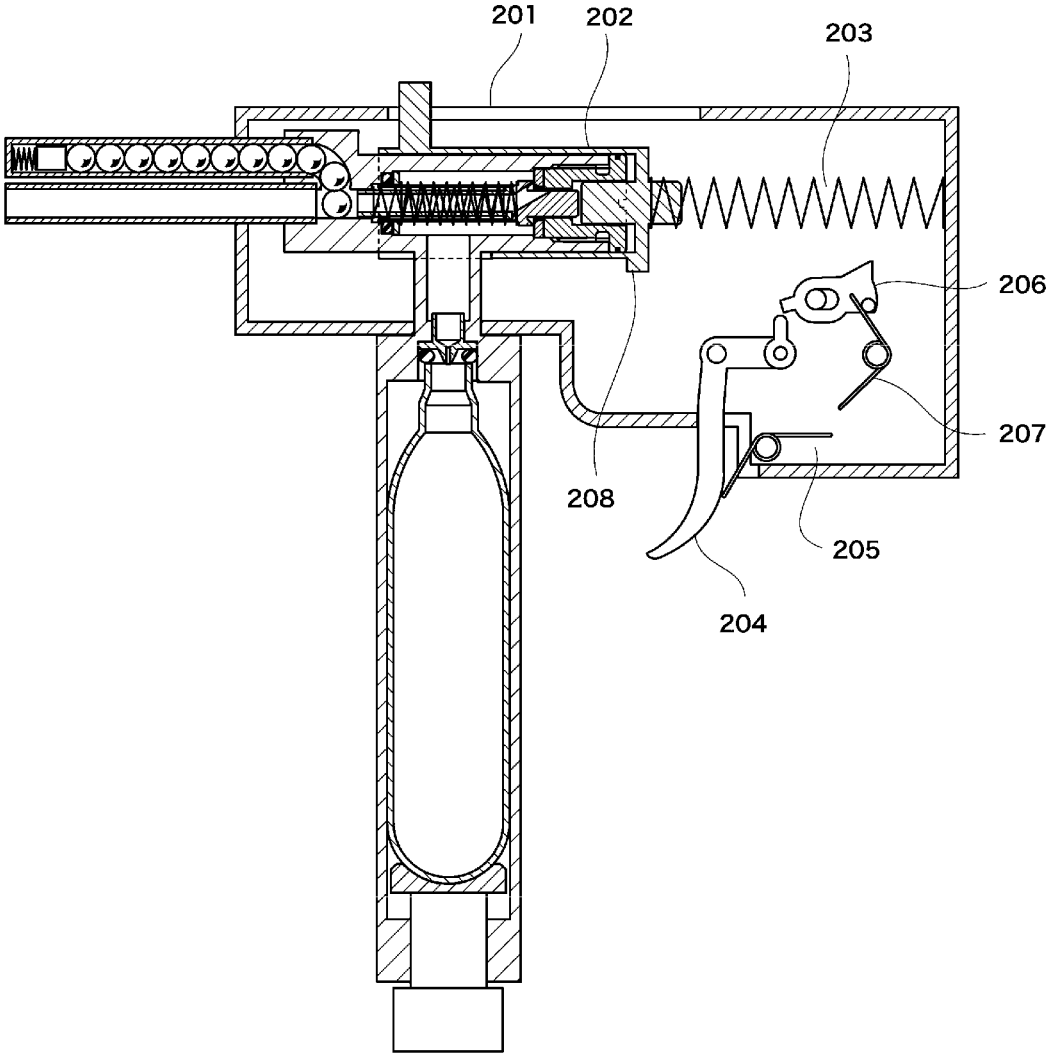
FIG. 11 is a left side sectional view showing the initial state of an open bolt type air gun with a conventional semiautomatic mechanism.
Figure 12:
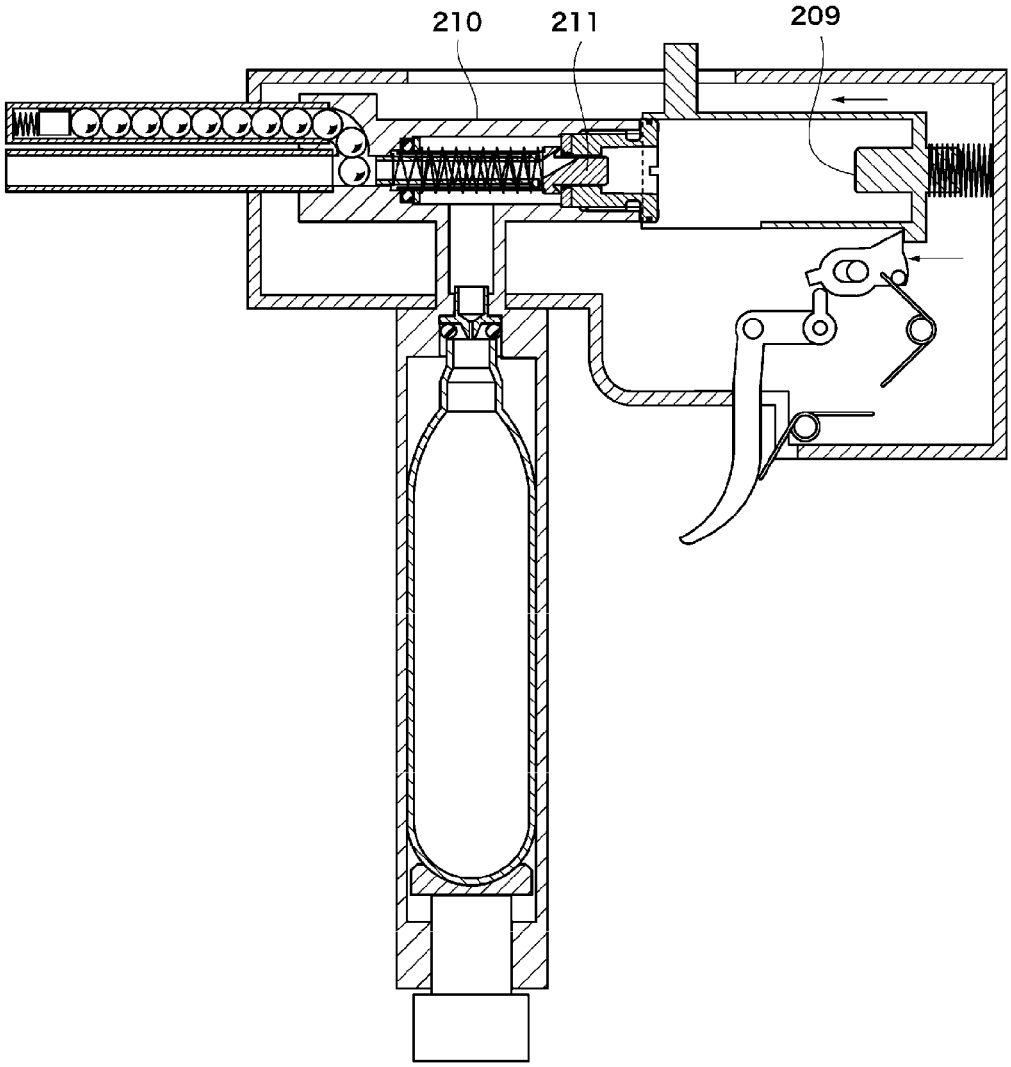
FIG. 12 is a left side sectional view showing a cocked state after the state shown in FIG. 11.
Figure 13:
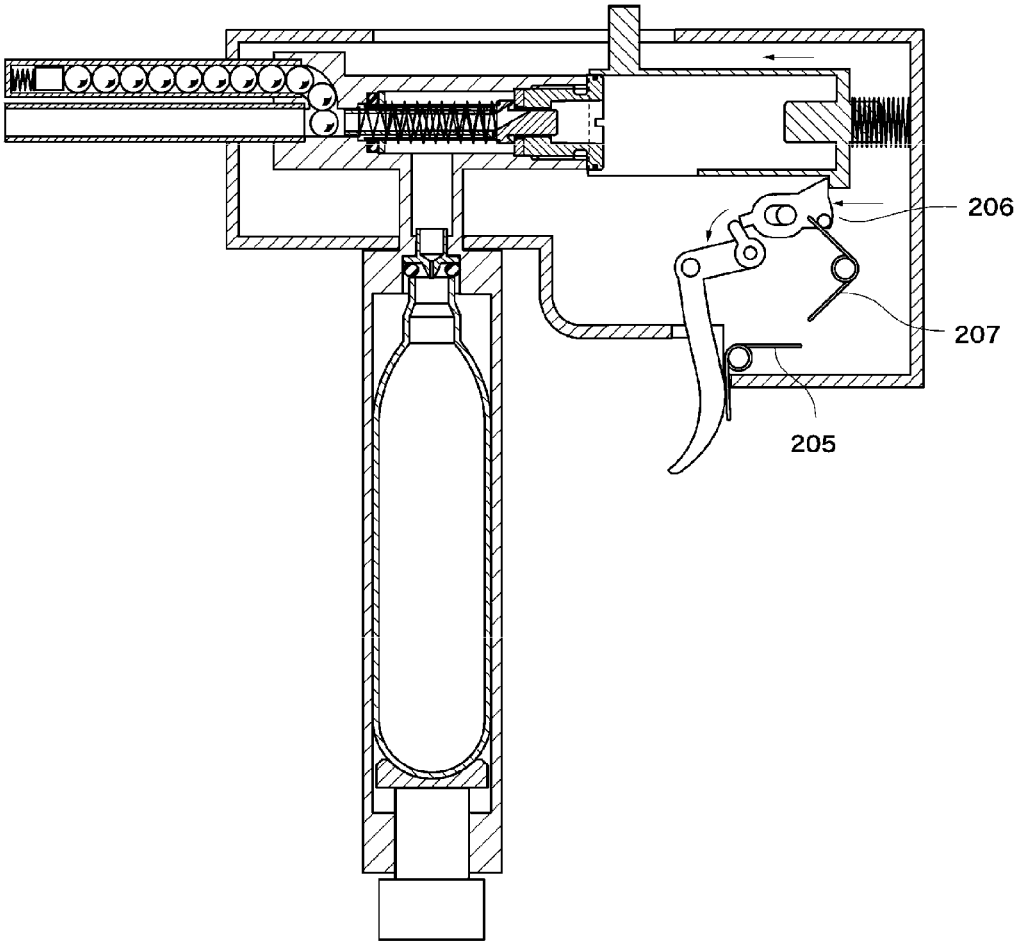
FIG. 13 is a left side sectional view showing a state of the open bolt type air gun with a conventional semiautomatic mechanism in which the bolt moves backward and is locked by the sear.

Next, a state in which the bolt stops since the bolt fails to move backward enough to touch the sear due to a gas pressure drop will be explained referring to FIG. 10.

It may happen that the bolt 2 cannot move backward enough to engage with the sear 4 due to a gas pressure drop caused by continuous shooting. In that case, the bolt 2 stops moving backward without engagement between the locking projection 2*b* of the bolt 2 and the bolt locking projection 4*a* of the sear 4 and due to the biasing force of the bolt spring 3, the bolt 2 begins moving forward again. At this time, the inner safety 10 is in its initial position, so the locking projection 2*b* of the bolt 2 touches and engages with the bolt locking projection 10*a* of the inner safety 10, thereby hampering forward movement of the bolt 2. Meanwhile, there is enough space between the hit pin 21 and discharge valve 19. Therefore, the hit pin 21 in the bolt 2 does not hit the discharge valve 19 and no bullet firing occurs. In this state, by returning the trigger 12, the trigger bar A 6 moves backward and returns to its initial position and the state (initial state) shown in FIG. 2 is restored. This prevents the gun in semiautomatic mode from working due to a gas pressure drop as if it were in fully automatic mode, thereby ensuring product reliability.

The foregoing merely illustrates the principles of the present disclosure. Various modifications and alternations to the described embodiments will be apparent to those skilled in the art in view of the teaching herein. It will thus be appreciated that those skilled in the art will be able to devise numerous systems, arrangements and methods which, although not explicitly shown or described herein, embody the principles of the present disclosure and are thus within the sprit and scope of the present disclosure. In addition, to the extent that the prior art knowledge has not been explicitly incorporated by reference herein above, it is explicitly being incorporated herein in its entirety.

What is claimed is:

1. A toy gun comprising:

a barrel extending in a longitudinal direction of a gun body;

a valve body in a shape of a cylinder extending in the longitudinal direction of the gun body, forming therein an air chamber filled with compressed gas, communicating with a rear end of the barrel at a front side and having a through hole penetrating in the longitudinal direction of the gun body at a rear side;

a discharge valve located inside the valve body, and provided movably between a closed position for closing communication between the barrel and the air chamber and an open position, more forward than the closed position, for opening the communication between the barrel and the air chamber;

a discharge valve spring pushing the discharge valve backward and bringing the discharge valve into the closed position;

a bolt located slidably in the longitudinal direction of the gun body, having an opening at a front and a closed end at a rear, having therein a contact part for pushing the discharge valve from behind, having, on a lateral side, a cam part oriented backward from a portion extending in a forward direction of the gun body, and having a locking projection extending downward from a bottom of the rear closed end and sloping upward from front to back;

a bolt spring pushing the bolt forward;

a sear located below the bolt, having a projection to come into contact with the locking projection of the bolt;

a first trigger bar located turnably below the sear, having a bolt contact part extending upward at or around a front end to come into contact with the cam part of the bolt, and on a lateral side, a locking projection for locking the sear;

an inner safety located forward of the sear, having a projection to come into contact with the locking projection of the bolt; and a second trigger bar located below the inner safety and forward of the first trigger bar slidably in the longitudinal direction, having on a lateral side a locking projection for locking the inner safety.

2. The toy gun according to claim 1, wherein the sear includes a shaft, a backward protrusion extending backward from the shaft, a downward protrusion extending downward from the shaft, and a locking projection protruding upward from a rear end of the backward protrusion to come into contact with the locking projection of the bolt; and/or wherein the inner safety includes a shaft, a backward protrusion extending backward from the shaft, a downward protrusion extending downward from the shaft, and a locking projection protruding upward from a rear end of the backward protrusion to come into contact with the locking projection of the bolt.

3. The toy gun according to claim 2, wherein the first trigger bar and the second trigger bar are arranged so that when the valve moves backward and engages with the sear and a trigger coupled to the first trigger bar is in an initial state, a front end of the first trigger bar comes into contact with a rear end of the second trigger bar and the first trigger bar and the second trigger bar are in alignment with each other.

4. The toy gun according to claim 1, wherein the cam part of the bolt is so shaped as to have a front flat portion, a middle slope, and a rear flat portion in order continuously from front to back.

5. The toy gun according to claim 4, wherein the first trigger bar and the second trigger bar are arranged so that when the valve moves backward and engages with the sear and a trigger coupled to the first trigger bar is in an initial state, a front end of the first trigger bar comes into contact with a rear end of the second trigger bar and the first trigger bar and the second trigger bar are in alignment with each other.

6. The toy gun according to claim 1, wherein the first trigger bar and the second trigger bar are arranged so that when the valve moves backward and engages with the sear and a trigger coupled to the first trigger bar is in an initial state, a front end of the first trigger bar comes into contact with a rear end of the second trigger bar and the first trigger bar and the second trigger bar are in alignment with each other.

* * * * *